US009610679B2

(12) United States Patent
Henke et al.

(10) Patent No.: US 9,610,679 B2
(45) **Date of Patent: *Apr. 4, 2017**

(54) TOOL HANDLE AND METHOD FOR MAKING SAME

(71) Applicant: WARNER MANUFACTURING COMPANY, Minneapolis, MN (US)

(72) Inventors: David R. Henke, Maple Grove, MN (US); Steven L. Thompson, Buffalo, MN (US)

(73) Assignee: WARNER MANUFACTURING COMPANY, Minneapolis, MN (US)

( * ) Notice: Subject to any disclaimer, the term of this patent is extended or adjusted under 35 U.S.C. 154(b) by 323 days.

This patent is subject to a terminal disclaimer.

(21) Appl. No.: 14/471,875

(22) Filed: Aug. 28, 2014

(65) Prior Publication Data

US 2014/0366320 A1 Dec. 18, 2014

Related U.S. Application Data

(63) Continuation of application No. 13/416,385, filed on Mar. 9, 2012, now Pat. No. 8,844,410.

(60) Provisional application No. 61/451,219, filed on Mar. 10, 2011.

(51) Int. Cl.

| | |
|---|---|
| ***B25G 1/08*** | (2006.01) |
| ***B25G 1/10*** | (2006.01) |
| ***B25G 3/00*** | (2006.01) |

(52) U.S. Cl.

CPC ..... *B25G 1/08* (2013.01); *B25G 1/10* (2013.01); *B25G 3/00* (2013.01); *Y10T 16/444* (2015.01); *Y10T 29/49826* (2015.01)

(58) Field of Classification Search

CPC .... B25G 1/08; B25G 1/10; B25G 3/00; B29C 45/1671; B29C 45/1676; B29L 2031/463; B29L 2031/753; Y10T 16/444; Y10T 29/49826

See application file for complete search history.

(56) References Cited

U.S. PATENT DOCUMENTS

| | | | |
|---|---|---|---|
| 1,974,682 | A | 9/1934 | Margoshes |
| 2,175,481 | A | 10/1939 | Padulo |
| 4,739,536 | A | 4/1988 | Bandera et al. |
| 5,008,970 | A | 4/1991 | Tsai |
| 5,964,009 | A | 10/1999 | Hoepfl et al. |
| 6,094,781 | A | 8/2000 | Jansson et al. |
| 6,108,870 | A | 8/2000 | Lo |
| 6,122,802 | A | 9/2000 | Lo |

(Continued)

*Primary Examiner* — David B Thomas

(74) *Attorney, Agent, or Firm* — Hamre, Schumann, Mueller & Larson, P.C.

(57) ABSTRACT

A tool apparatus comprises an operative member and a handle connected to the operative member. The handle comprises a core element having an elongated body, an outer surface and first and second ends opposite to each other. At least the second end is connected to the operative member. The tool handle also comprises at least one cavity extending inwardly from the outer surface of the core element and a plurality of insert blocks selectively receivable in the cavity. The tool handle further comprises an overlay disposed on the core element, wherein a height of the projection on exterior surface of the insert block is no less than a thickness of the overlay, thereby exposing the upper surface to an external environment so as to be visible to a viewer.

20 Claims, 13 Drawing Sheets

(56) References Cited

U.S. PATENT DOCUMENTS

| | | | | |
|---|---|---|---|---|
| 6,132,834 | A | 10/2000 | Ackeret et al. | |
| 6,134,743 | A * | 10/2000 | Schmidt | A47L 13/022 15/111 |
| 6,199,460 | B1 | 3/2001 | Lo | |
| 6,228,306 | B1 | 5/2001 | Hoepfl et al. | |
| 6,230,366 | B1 | 5/2001 | Lin | |
| 6,368,536 | B1 | 4/2002 | Hoepfl et al. | |
| 6,473,939 | B1 | 11/2002 | Stegmaier | |
| 6,594,863 | B2 | 7/2003 | Spooner | |
| 6,668,751 | B1 | 12/2003 | Henke | |
| 6,726,868 | B1 | 4/2004 | Panfili et al. | |
| 7,055,407 | B2 | 6/2006 | Gringer et al. | |
| 7,093,523 | B2 | 8/2006 | Gamba et al. | |
| 7,195,567 | B2 | 3/2007 | Lu | |
| 8,032,991 | B2 | 10/2011 | Lawless | |
| 8,844,410 | B2 * | 9/2014 | Henke | B25G 1/10 264/247 |
| 8,927,083 | B2 * | 1/2015 | Pell | B25G 1/10 16/110.1 |
| 2007/0266831 | A1 | 11/2007 | Matthias et al. | |
| 2009/0078090 | A1 | 3/2009 | Halder et al. | |
| 2009/0139051 | A1 | 6/2009 | Hobbs | |
| 2010/0107826 | A1 | 5/2010 | Gauthier et al. | |
| 2010/0117262 | A1 | 5/2010 | Gringer | |
| 2010/0180400 | A1 | 7/2010 | Pell | |

* cited by examiner

TOOL HANDLE AND METHOD FOR MAKING SAME

FIELD

This disclosure relates generally to a tool handle, in particular a handle of a hand tool and a method for making the same.

BACKGROUND

Hand tools, such as putty knives, chisels, screwdrivers, bucket openers, hand saws, sanders, or multipurpose tools, typically include an operative member and a handle. There are some types of handles and handle-like structures formed by molding and over molding, e.g., molding a first material over a second or core material. Often, some form of logo or brand is provided on the core material viewable after over molding. To mold cores with different logos, typically, different molds are required. When various logos are used for customizing the hand tools for individual customers, the molding process of the core can become rather complicated.

SUMMARY

Tools and methods are described in an application involving a type of hand tools that includes an operative member having a substantially flat blade. This type of hand tools are widely used for caulking, spreading, as well as scraping jobs and are commonly referred to as putty knives. However, it is to be understood that the present tools and methods may include other types of tools, including, but not limited to, chisels, screwdrivers, bucket openers, hand saws, sanders, shovels or multipurpose tools.

In one embodiment, a tool apparatus comprises an operative member and a handle connected to the operative member. The handle comprises a core element having an elongated body, an outer surface and first and second ends opposite to each other. At least the second end is connected to the operative member. The tool handle also comprises at least one cavity extending inwardly from an outer surface of the core element and at least one insert block receivable in the cavity. The insert block has an exterior surface and at least one projection extending outwardly from the exterior surface and having an outline of perimeter in the form of at least a part of desired indicia, such as a company name or other logo. The projection includes an upper surface. The tool handle further comprises an overlay disposed on the core element, wherein a distance between the upper surface and the exterior surface of the insert block is no less than a thickness of the overlay, thereby exposing the upper surface to an external environment so as to be visible to a viewer.

In another embodiment, a method for fabricating a tool apparatus comprises fabricating an operative member and a handle connected to the operative member. Fabricating a handle comprises fabricating a core element having an elongated body, first and second ends opposite to each other. At least the second end is connected to the operative member. The core element has at least one cavity extending inwardly from an outer surface of the core element. Fabricating a handle also comprises fabricating at least one insert block receivable in the cavity. The insert block includes an exterior surface and at least one projection extending outwardly from the exterior surface and having an outline of perimeter in the form of at least a part of desired indicia, such as a company name or other logo. The projection includes an upper surface. Fabricating the handle also comprises disposing the insert block in the cavity so that the exterior surface of the insert block is leveled with the outer surface of the core element. Fabricating the handle further comprises covering the core element and the insert block with an overlay. The distance between the upper surface and the exterior surface of the insert block is no less than a thickness of the overlay, thereby exposing the upper surface to an external environment so as to be visible to a viewer.

This Summary is an overview of some of the teachings of the present application and not intended to be an exclusive or exhaustive description of the claimed invention. Further details about the present subject matter are found in the detailed description and appended claims. Other aspects of the subject matter will be apparent to persons skilled in the art upon reading and understanding the following detailed description and viewing the drawings that form a part thereof, each of which are not to be taken in a limiting sense. The scope of the claimed invention is defined by the appended claims and their equivalents.

DESCRIPTION OF THE DRAWINGS

The drawings, which are not necessarily drawn to scale, illustrate generally, by way of example, but not by way of limitation, various embodiments discussed in this application.

DETAILED DESCRIPTION

Figure 1A:
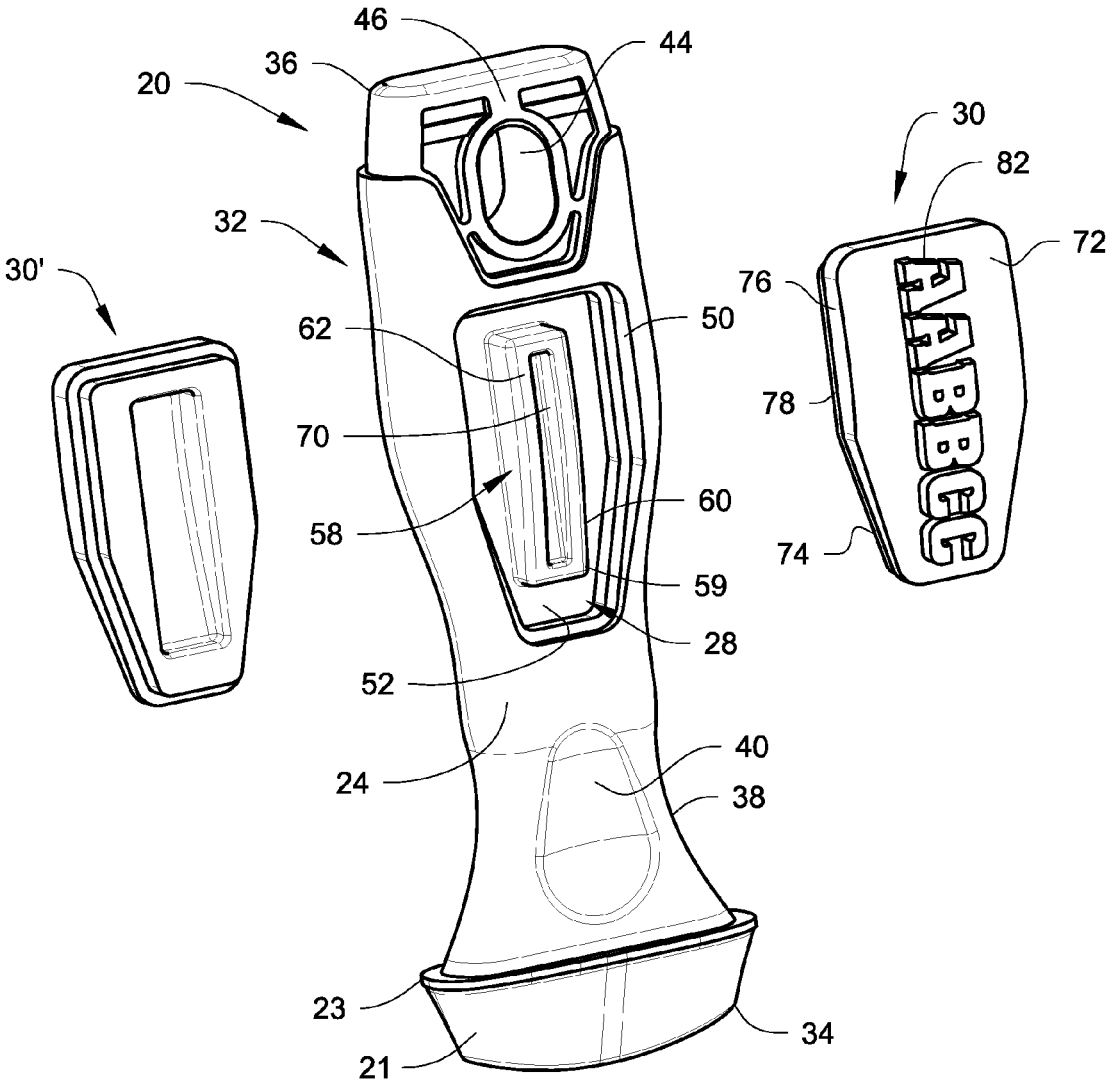
FIG. 1A illustrates an exploded view of a core element of a putty knife including insert blocks, the core element including a reinforcement section.

In the following detailed description, reference is made to the accompanying drawings which form a part thereof, and in which is shown by way of illustration specific embodiments in which the inventive concepts may be practiced. These embodiments are described in sufficient detail to enable those skilled in the art to practice the invention, and it is to be understood that the embodiments may be combined or used separately, or that other embodiments may be utilized and that structural and procedural changes may be made without departing from the spirit and scope of the inventive concepts. The following detailed description provides examples, and the scope of the present invention is defined by the claims to be added and their equivalents.

Tools and methods are described in an application involving a type of hand tools that includes an operative member having a substantially flat blade. This type of hand tools are widely used for caulking, spreading, as well as scraping jobs and are commonly referred to as putty knives. However, it is to be understood that the present tools and methods may include other types of tools, including, but not limited to, chisels, screwdrivers, bucket openers, hand saws, sanders, shovels or multipurpose tools.

The terms "above," "on," "under," "top," "bottom," "upper," "lower," "front," "rear" and the like used herein are in reference to the relative positions of the tool and its constituent parts, in use when oriented as in FIGS. 1A-G, 2A-B, 3A-C and 4.

With reference to FIGS. 1E-F, 2B and 3C, a putty knife 10, 110, 310, 510 includes a handle 14, 114, 314, 514 and an operative member 12, 112, 312, 512 suitably connected to the handle 14, 114, 314, 514.

With reference to FIGS. 1A-E, the handle 14 has an elongated body around which a user wraps his or her fingers to grasp and operate the tool. The handle 14 has a first, free end 16 and a second end 18 to which the operative member 12, e.g., the blade, is mounted. The handle 14 is manufactured to include an elongated core element 20 including at least one cavity 28, at least one insert block 30 to be received in the cavity 28 of the core element and an overlay 22 covering the core element 20 to, e.g., enhance the user's grasp of the handle 14.

FIGS. 1A-D show an uncovered core element 20. The core element 20 has an elongated body 32 having a generally rectangular cross section, an end 34 (second end) adapted to receive the operative member 12, another end 36 (first end) opposite to the end 34. It is to be understood that the body 32 of the core element 20 can also have a cross section that is in other shapes, e.g., ellipse, circular, or square.

The core element 20 also includes a longitudinal axis o-o' and an outer surface. The outer surface includes a first surface 24 that is an exterior surface, a second surface 26 opposite to the first surface 24. It is to be understood that the core element can be of a configuration that does not have an exterior surface, e.g., when the core element has a circular cross section.

The core element 20 includes at least one cavity 28 extending inwardly from an outer surface of the core element for receiving the insert block 30. The core element 20 also includes an aperture 44 adjacent the first end 36 for hanging the tool. A plurality of ribs 46 are provided on a periphery of the aperture 44 for, e.g., supporting the aperture 44.

With reference to FIGS. 1A-D, the core element 20 is configured to provide a volume for gripping and is shaped and contoured to facilitate handling. For example, the core element 20 may include a plurality of depressions that help prevent slippage of the user's hand during use. The configuration of the elongated core element may vary to suit individual applications.

The core member 20 can be integrally molded with a relatively rigid material. By using the relatively rigid material, the core element imparts structural strength to the handle 14. Specifically, the core element 20 may be made from nylon, rubber or urethane. In one embodiment, the core element is formed by injection molded polypropylene or polycarbonate.

In one embodiment as shown in FIGS. 1A-D, the elongated body may further include a reinforcement section 38 adjacent to the second end 18 of the handle 14. The reinforcement section 38 is configured to include at least a recess 40 in the first surface 24. In the embodiment illustrated in FIGS. 1A-D, the recess 40 is formed on each of the first and second surfaces 24, 26 to allow the user's thumb or forefinger to apply extra force when the tool is used in heavier applications, like scraping.

In an alternative embodiment, the core element 20 does not include the reinforcement section 38 for tools to be used in a relatively lighter application, like spreading and applying compounds. FIGS. 1F-G illustrate a putty knife 110 that does not include a reinforcement section.

In one embodiment, the core element 20 also includes a collar portion 21 that terminates the second end 34. The collar includes a rim 23 sized larger than the circumference of the outer surface of the core element that is adjacent to the collar portion 21. In one embodiment, the height of the rim 23 is generally identical to the thickness of the overlay 22.

Figure 2A:
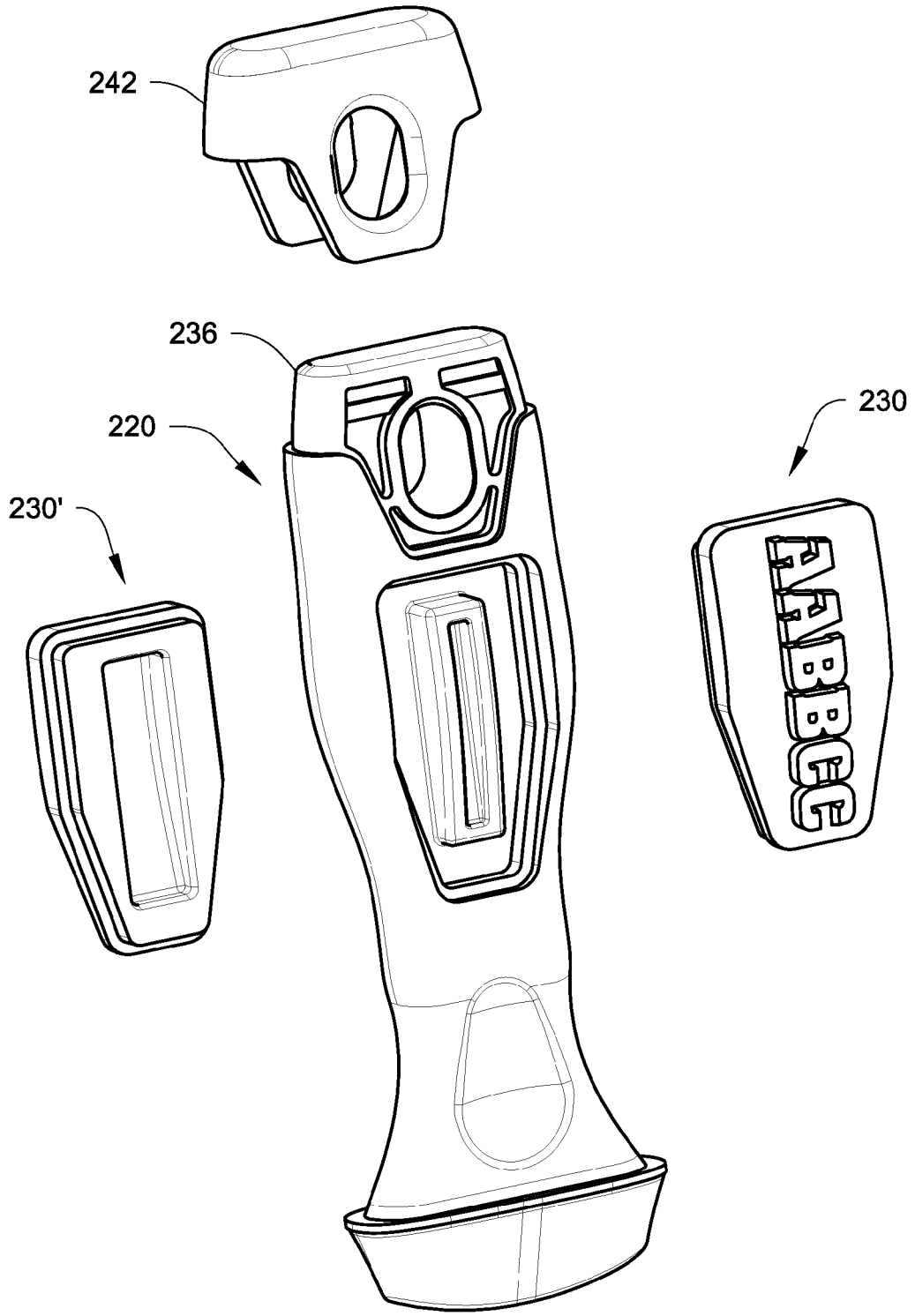
FIG. 2A illustrates the core element and insert blocks of FIG. 1A and further including a hammer cap.

With reference to FIG. 2A, the core element 220 and the insert block 230 have the same configuration as the core element 20 and insert block 30, respectively. A hammer cap 242 is added at a first end 236 of the core element 220 to allow the putty knife to do jobs like setting nails in addition to spreading and scraping.

Figure 3A:
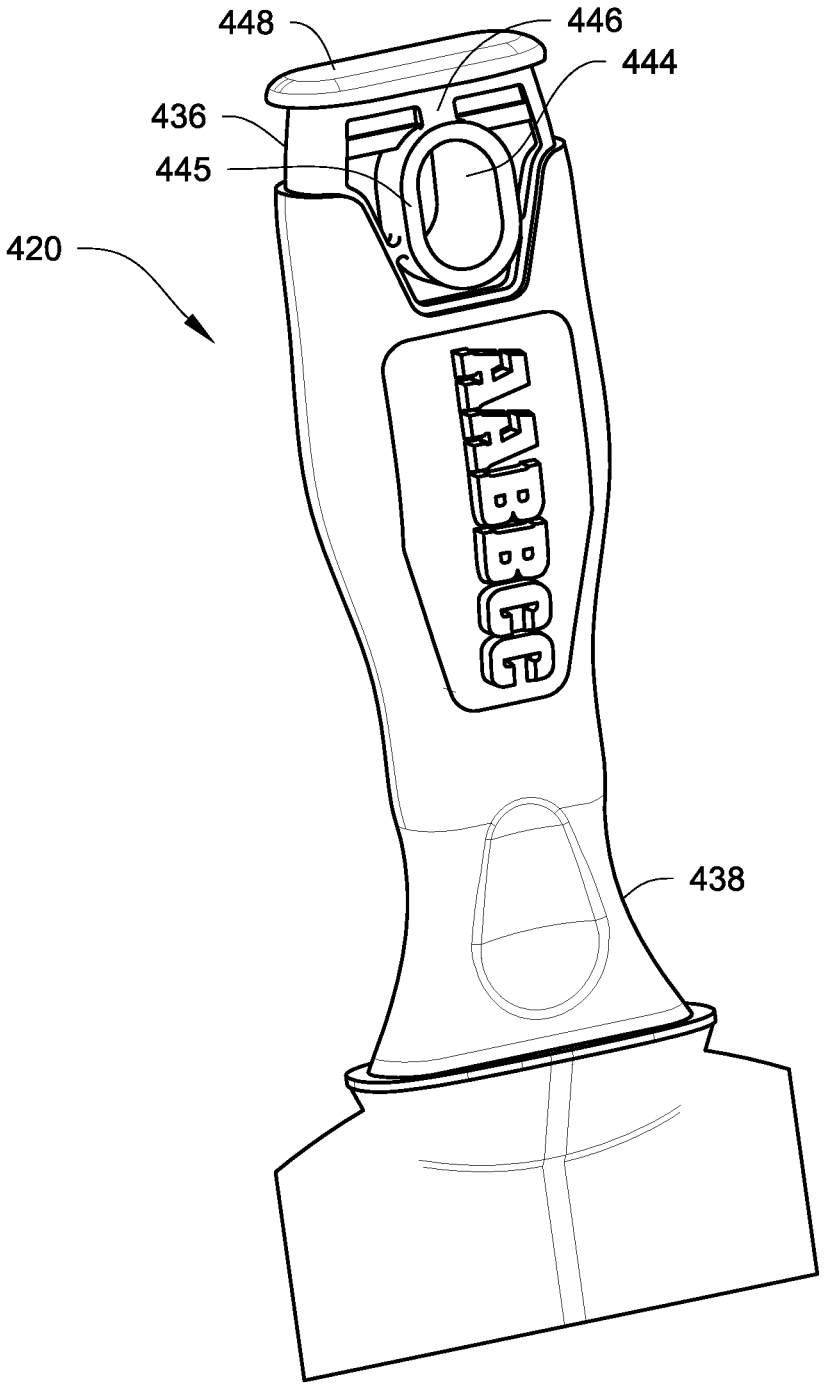
FIG. 3A illustrates a perspective view of a core element of a putty knife including insert blocks, the core element including a reinforcement section and further including a plastic cap end.
Figure 3B:
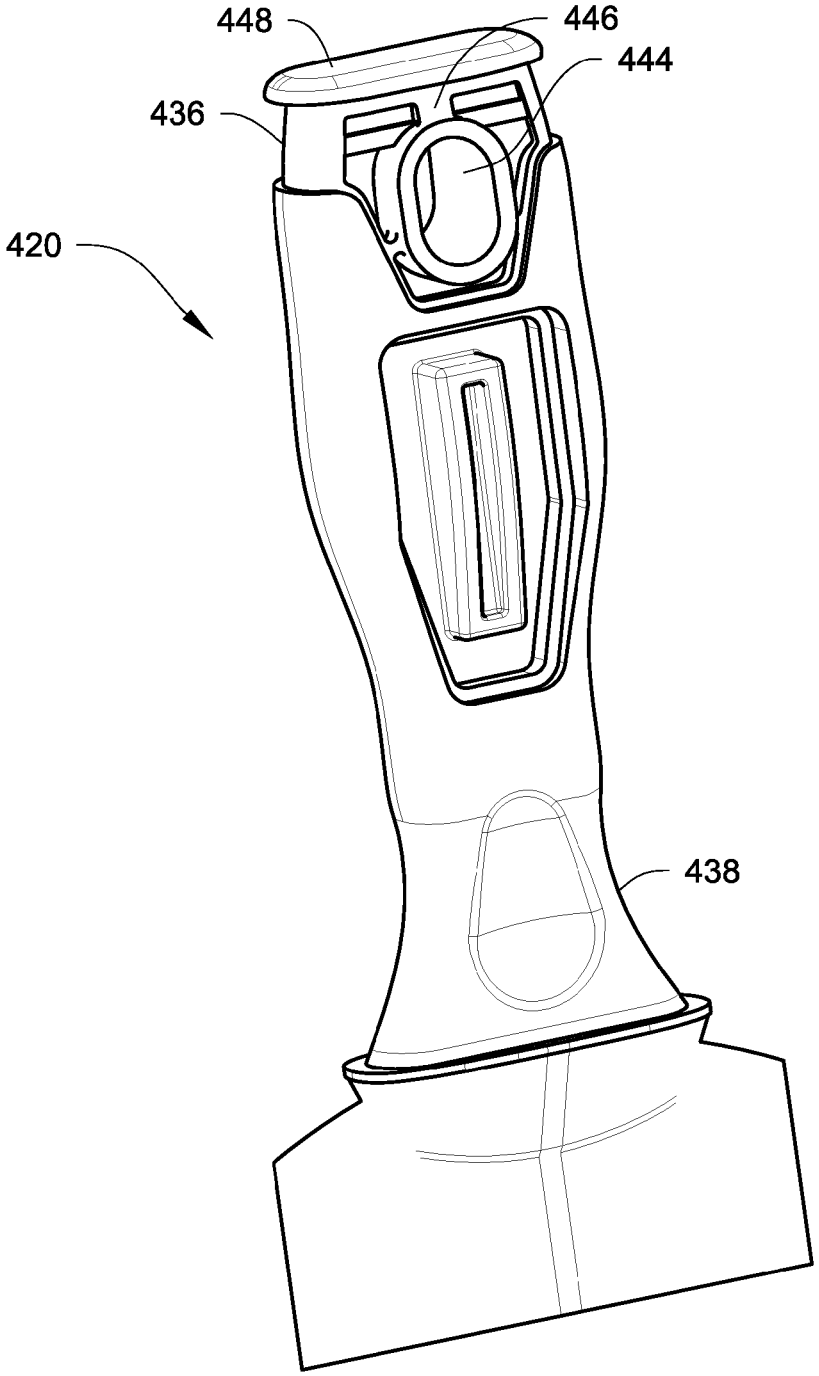
FIG. 3B illustrates a perspective view of the core element of FIG. 3A with the insert blocks being removed.

With reference to FIG. 3A, the core element 420 has a similar configuration as the core element 20, 220 with the shape of a first end 436 being changed to include a plastic cap 448. The plastic cap 448 allows the putty knife to do jobs like chiseling in addition to spreading and scraping. As shown in FIG. 3A, a wall of the aperture 444 adjacent the first end 436 of the core element 420 is raised beyond the top and bottom surfaces of ribs 446 such that the top and bottom surfaces 445 of the raised wall of the aperture 344 are to be substantially leveled with an outer surface of the overlay and form a part of the outer surface of the handle.

With reference to FIGS. 1A-D, the cavity 28 extends inwardly from the first surface 24 of the core element 20. The cavity 28 includes an opening 50, a bottom surface 52, and an inner perimeter wall 54 positioned perpendicular to the bottom surface 52. It is to be understood that the opening 50 can have various shapes, e.g., circular, ellipse, rectangular, square or irregular and the inner perimeter wall does not have to be perpendicular to the bottom surface 52. It is also to be understood that the location of the cavity 28 can vary as desired. The depth of the cavity 28 is generally less than one half of the thickness between the first and second surfaces 24, 26. However, it is to be understood that the depth of the cavity can be greater as desired.

With reference to FIGS. 1A-D, a stepped portion 56 is formed at the upper edge of the inner perimeter wall 54. The width and the height of the stepped portion can be selected as desired. The cavity 28 includes a protrusion portion 58 protruding from the bottom surface 52 toward the opening 50. A top surface 64 of the protrusion portion 58 tracks the configuration of the first surface 24 and is divided into a front section 60 and a rear section 62. The rear section 62 is positioned in a plane generally parallel to the bottom surface 52. The front section 60 is curved and inclined toward the front and the bottom of the cavity 28. The lowest point 59 of the top surface 64 of the protrusion portion 58 is positioned not lower than the stepped portion 56.

The protrusion portion 58 includes an indentation 66 defined in the top surface 64. The indentation 66 includes a bottom surface 68 and a perimeter wall 70. The bottom surface 68 is positioned parallel to the bottom surface 52 of the cavity 28 and is positioned slightly lower than the lowest point 59 of the top surface 64 of the protrusion portion 58. It is to be understood that the specific configuration of the protrusion portion 58 can vary as desired.

In the embodiment as shown in FIGS. 1A-D, another cavity 28' extends inwardly from the second surface 26 of the core element 20. In an alternative embodiment, the second surface is located adjacent to the first surface 24, instead of being opposite to the first surface 24. It is to be understood that the cavity 28 can be located at any location of the handle 14 and the number of the cavities can vary.

Figure 1B:
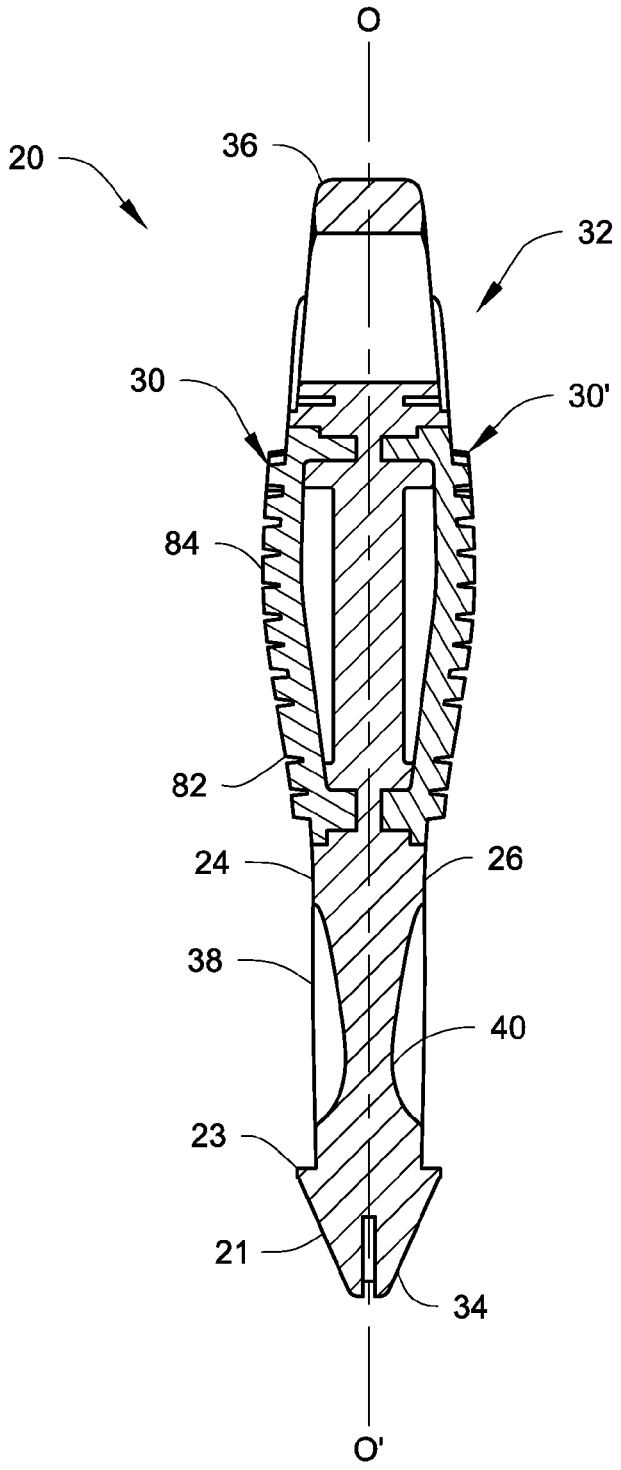
FIG. 1B illustrates a cross-section view of the core element including the insert blocks of FIG. 1A.
Figure 1C:
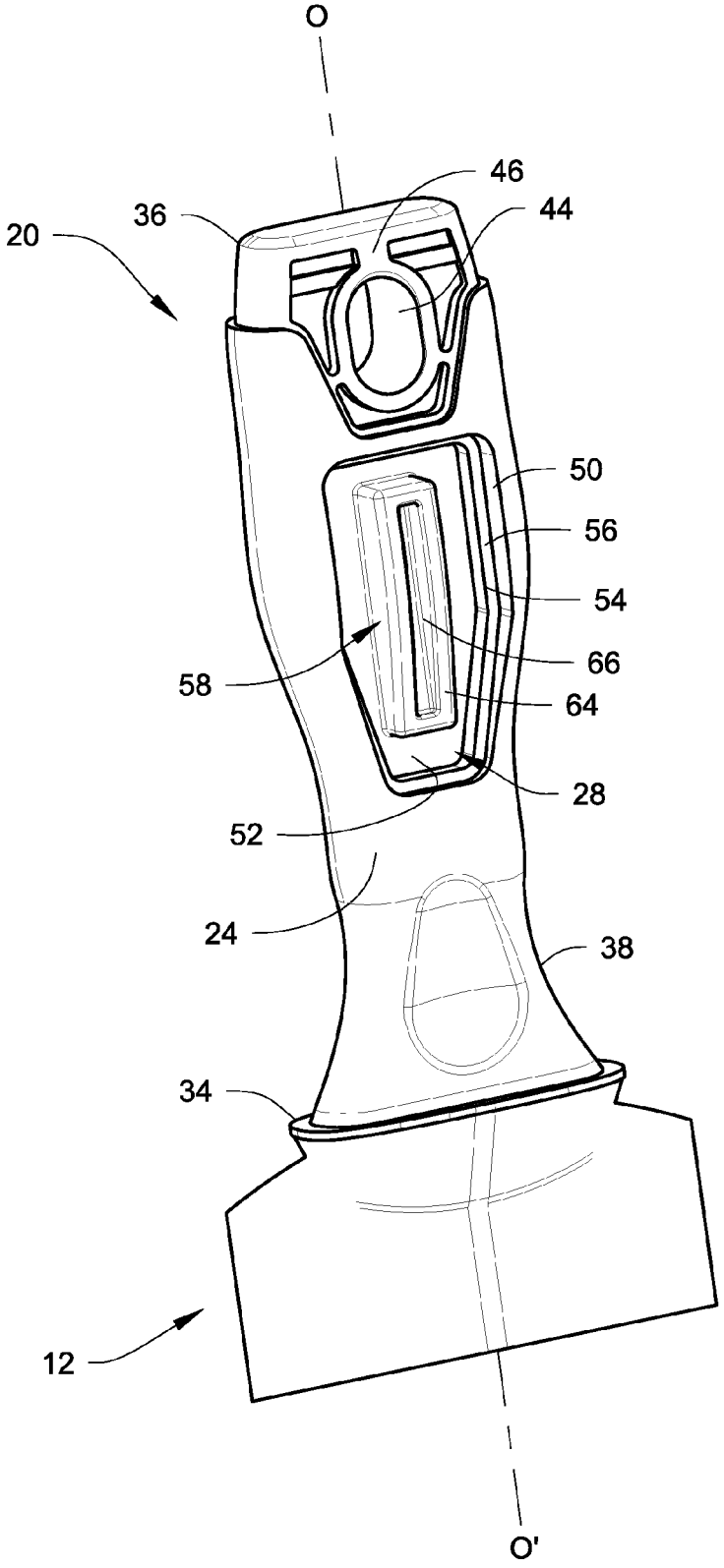
FIG. 1C illustrates a perspective view of the core element of FIG. 1A with the insert blocks being removed.
Figure 1D:
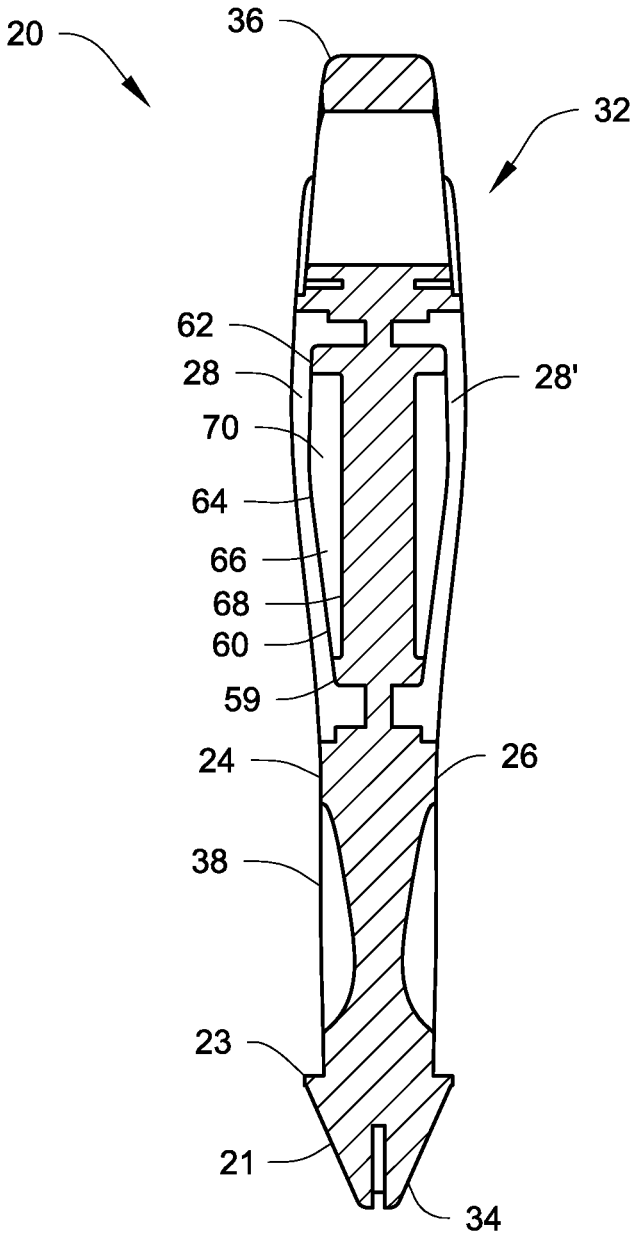
FIG. 1D illustrates a cross-section view of the core element of FIG. 1C.
Figure 4:
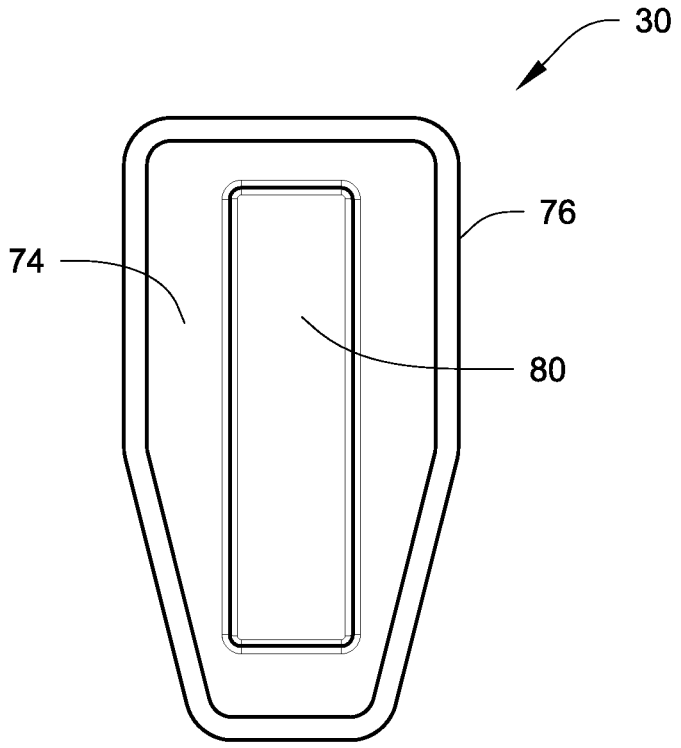
FIG. 4 illustrates a bottom view of an insert block.

With reference to FIGS. 1A-B and 4, the insert block 30 includes a top surface 72, a bottom surface 74 and an outer perimeter wall 76. A perimeter recess 78 is formed at the lower edge of the outer perimeter wall 76. The insert block 30 also includes a receptacle 80 extending toward the top surface 72 from the bottom surface 74. In the embodiment as show in FIG. 4, the bottom view of the receptacle 80 is in a rectangular shape. The receptacle 80 is constructed to receive the protrusion portion 58 located in the cavity 28. It is to be understood that the specific configurations of the receptacle 80 and the protrusion portion 58 can vary as desired as long as the protrusion portion 58 is receivable in the receptacle 80.

The insert block 30 is sized to be received in the cavity 28 of the core element 20. The top surface 72 of the insert block is constructed to track the configuration of the first surface 24 of the core element 20 when the insert block 30 is received in the cavity 28. As a result, when the insert block 30 is received in the cavity, a lower surface of the recess 80 rests on an upper surface of the stepped portion 56, and the top surface 72 of the insert block 30 and the first surface 24 of the core element 20 are substantially leveled with each other.

The outer perimeter 76 of the insert block 30 is sized to provide an interference fit with an inner periphery of the stepped portion 58. Also, a periphery wall of the perimeter recess 78 is sized to provide an interference fit with the inner perimeter wall 54 of the cavity 28. The inner periphery of the receptacle 80 is sized to receive the protrusion portion 58. The receptacle 80 together with the protrusion portion 58 provide additional contact surfaces for interference fit and thus help retain the insert block 30 more firmly in the cavity 28.

In the embodiment illustrated in FIGS. 1A-D, the handle 14 includes two insert blocks 30, 30' that are to be received in cavities 28, 28', respectively.

It is to be understood that although in FIGS. 1A-B, interference fit is used for retaining the insert block 30 in the cavity 28, other fastening methods, e.g., adhesives, snap fit connections, etc., can be used for retention of the insert block 30, 30'. In an embodiment, the interference fit is not needed at least between some surfaces, or alternatively, is not needed at all, as long as the insert block 30, 30' is receivable in the cavity 28.

The insert block 30 also includes at least one projection 82 extending outwardly from the top surface 72 and having an outline or perimeter in the form of at least a part of desired indicia such as a company name or other logo, as for instance, AABBCC. Each projection includes an upper surface 84. As used in this specification and claims, the term "indicia" refer to any mark intended to convey information to the viewer. For example, indicia may include letters, numerals, symbols, characters, designs, logos, pictures, decorations, shapes, geometries, textures, colors or combinations thereof, among other means of relaying information to the viewer.

Figure 1E:
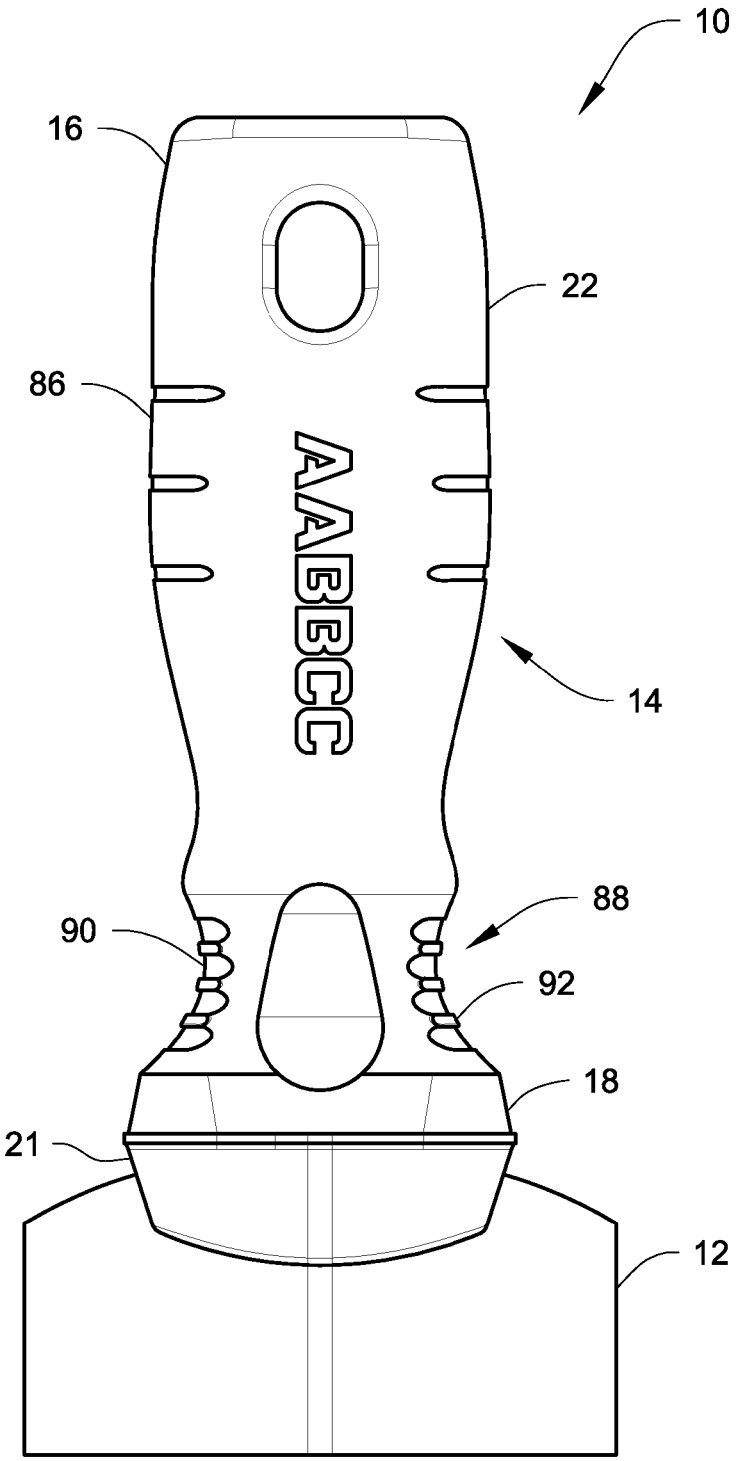
FIG. 1E illustrates a top view of a putty knife including the core element of FIGS. 1A-D with a free end being a soft end.
Figure 1F:
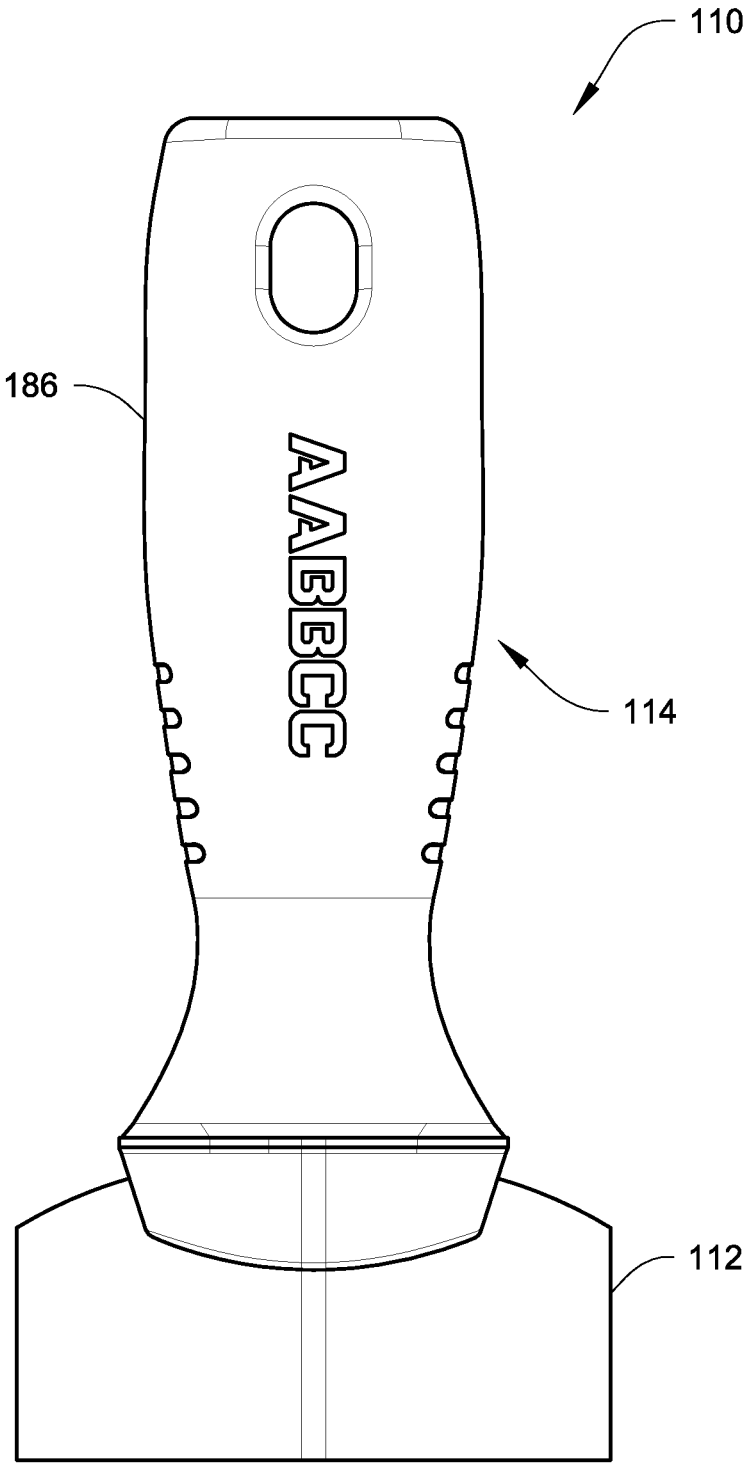
FIG. 1F illustrates a top view of a putty knife without a reinforcement section with a free end being a soft end.
Figure 1G:
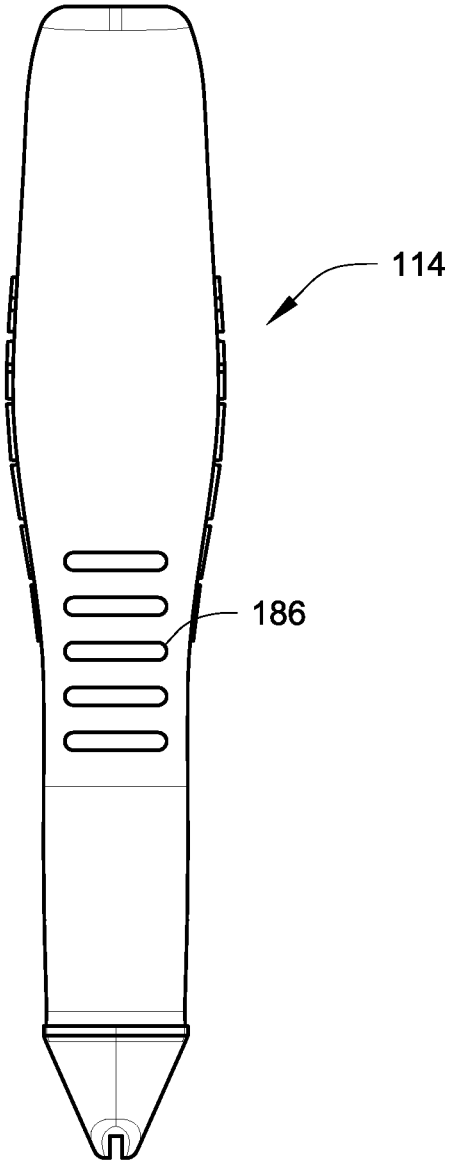
FIG. 1G illustrates a side view of a handle of FIG. 1F.

With reference to FIGS. 1A-B and 1E, the indicia are provided as raised letters on the top surface 72. In one embodiment, when the insert block 30 is received in the cavity 28, the upper surface 84 of the projection 82 generally track the configuration of the first surface 24 of the core element 20. The height of the indicia is generally identical to the thickness of the overlay 22 to allow the raised indicia to penetrate the overlay 22 and the upper surface 84 of the projection 82 is exposed to the external environment so as to be visible to the viewer.

The indicia can be used to display the retailer's brand on the handle or promote other partner brands. They can display purchase guide information, how-to information, country of origin information or a unique message. In one embodiment, the indicia are used to include at least a mark that conveys information regarding characteristics of the operative member 12 of the hand tool to the viewer. Hand tools having a handle and an operative member often look similar even though they may be of different sizes and have operative members with different characteristics.

With respect to putty knives, due in large part to different blade flexibility, putty knives are designed to do different jobs. A user makes a selection of a putty knife based on the type of job. For example, if the blade is very flexible, it can be used for spreading materials like light weight drywall compound and spackle; if the blade is somewhat flexible, it can be used for caulking, drywall mud, window putty and other compound spreading, and easier scraping jobs; if the blade is stiff, it can be used for heavy scraping jobs. Since putty knives look the same from the handle and from the blade itself, it is often difficult to readily identify the proper type of tool. For example, a user may stop working and randomly test different putty knives until the putty knife with the right blade flexibility is selected. Also, when a purchaser wants to purchase a putty knife with the right blade flexibility to do a certain job, the purchaser often needs to examine the putty knife and read the description closely before making a decision. Even then, the purchaser may not know which type of putty knife is appropriate for the job to be done.

In one embodiment, the indicia include information indicating an operating characteristic of the operative member. Thus, by looking at the indicia, one can easily select a hand tool having an operating characteristic suitable to do the certain type of job.

For example, indicia can be used to identify different blade flexibility of a putty knife. The indicia "FLEX" represent that the blade flexibility of the putty knife is moderately flexible. The indicia "FULL FLEX" represent that the blade flexibility is very flexible. The indicia "STIFF" represent that the blade flexibility is relatively stiff. It is to be understood that the indicia representing the blade flexibility could be varied and that more or less gradations of blade flexibility might be represented.

Thus, with the configuration as discussed above, a user or a purchaser can easily identify a putty knife by looking at the indicia on the handle, and select the putty knife having the right blade flexibility to do the job.

Table 1 provides examples of types of information that can be identified by indicia. In the instances that more information needs to be provided on the handle, multiple insert blocks can be used in combination with multiple cavities to convey the information. For example, with reference to FIG. 1A, the indicia on the insert block 30 can be used to indicate the retailer's brand, while the indicia 30' can be used to indicate the flexibility of the operative member 12, e.g., FULL FLEX. In an alternative example, the indicia on the insert block 30 can be used to indicate a retailer's company name, while the indicia on the insert block 30' can be used to indicate the function of the operative member 12, e.g., APPLY. It is to be understood that, in addition to the information provided in Table 1, other types of information can be conveyed to the viewer by the indicia. It is also to be understood that information can be conveyed to a viewer by, e.g., multiple indicia.

TABLE 1

Example of types of information that can be identified by indicia

| Example of types of information that can be conveyed by indicia | Examples of indicia |
|---|---|
| Company name | For example, Company X, Company Y, Company Z, etc |
| Brand | For example, Brand A (e.g., Retailer's brand), Brand B (e.g., Partner 1's brand), Brand C (e.g.,Partner 2's brand), etc. |
| Flexibility of operative member | For example, Full Flex, Flex, Stiff, etc. |
| Size of operative member | For example, Size A, Size B, Size C, etc. |
| Function | For example, Scrape, Apply, Squeegee, Spread, etc. |
| Additional characteristics | For example, Chisel ground, Hammer cap, Plastic Cap, Bent, etc. |

In one embodiment, color coding can be used in combination with indicia. In one embodiment, color coding can be used to convey the same type of information as that conveyed by the indicia so that conveyance of the particular information is effectively enhanced. For example, color coding can be used to indicate flexibility of the operative member. In a more specific example, a blue color can be used to represent that the flexibility of the operative member is moderately flexible, a yellow color can be used to represent that the flexibility of the operative member is very flexible, and a red color can be used to represent that the flexibility of the operative member is relatively stiff. As a result, when the color of the indicia or another part of the handle that is visible to the viewer, e.g., the collar portion 21, is blue, and the indicia "FLEX" is used on the insert block, the information of moderately flexible conveyed by the color coding and the indicia are enhanced by each other.

In an alternative embodiment, the color coding can be used to convey a different type of information than the information conveyed by the indicia. For example, the indicia on the insert block 30 can be used to indicate that the operative member has a chisel ground, the indicia on the insert block 30' can be used to indicate a retailer's brand, while the color coding can be used to identify the flexibility of the operative member. It is to be understood that color coding can be used to convey other types of information, such as sizes of the operative member, etc.

With reference to FIG. 1E, the handle 14 includes the overlay 22 for, e.g., enhancing the user's grasp of the handle 14. As a result, the overlay 22 can form a cushion structure to impart flexibility and cushioning properties to the handle 14. The composite material of the overlay 22 may vary as long as the composite material of the core element and the composite material of the overlay have adhesive properties that allow chemical bonding between the two structures. The overlay 22 can be made of an elastomeric material having increased frictional properties, that is, typically increased frictional properties compared to the material of the core element 20, e.g., thermoplastic elastomer (TPE) or thermoplastic polyurethane.

The thickness of the overlay 22 may vary, thereby imparting relatively more or less flexibility to the handle 14. Additionally, the overlay 22 may not have a uniform thickness throughout, but may include local maximum and minimum thickness values.

Just as the thickness may vary, the configuration of the overlay 22 may also vary, though it has a configuration that generally compliments the configuration of the core element 20. The overlay 22 may be configured to promote flexibility and cushioning properties by changing the thickness of the cushion structure or increasing or decreasing the size of the core element 20 underlying the overlay. This will increase or decrease the relative flexibility and cushioning properties of the handle 14.

In one embodiment, the overlay 22 extends toward the second end 34 of the core element 28 and abuts the rim 23, exposing the collar 21 to an external environment so as to be visible to the viewer. As a result, the color of the collar can help convey information relating to the tool 10. In one embodiment, the color of the collar is blue, which represents, e.g., moderately flexible, and the color of the indicia is also blue, while the indicia are "FLEX." As a result, the information of moderately flexible conveyed by the color of blue and the indicia of "FLEX" are effectively enhanced.

With reference to FIGS. 1E-G, the handle 14, 114 may include surface roughening 86, 186, such as friction ribs, to increase a user's grip on the handle. These friction ribs help prevent slippage of user' hand during use of the tool. It is to be understood that the type and location of the surface roughening can vary depending on the specific application of the putty knife is used for.

In one embodiment as shown in FIG. 1E, the handle 14 includes a reinforcement section 88 having an overlay complimenting the reinforcement section 38 of the core element 20. The reinforcement section 88 includes a recess 90 corresponding to the recess 40 formed on the core element 20 to allow the user's thumb or forefinger to apply extra force, when the tool is used in heavier applications. Extra surface roughening 92 such as friction ribs may also be formed along sides of the reinforcement section 88. A user's hand can press against the friction ribs to provide easily engaged surface to inhibit slippage.

In an alternative embodiment as shown in FIGS. 1F-G, the handle 114 does not include the reinforcement section for tools to be used in a relatively lighter application, like spreading and applying compounds.

With reference to FIG. 1E, the first end 16 of the handle 14 is covered by the overlay 22 so that the first end 16 includes a comfortable soft end, allowing the user to scrape surfaces with no slippage or fatigue.

Figure 2B:
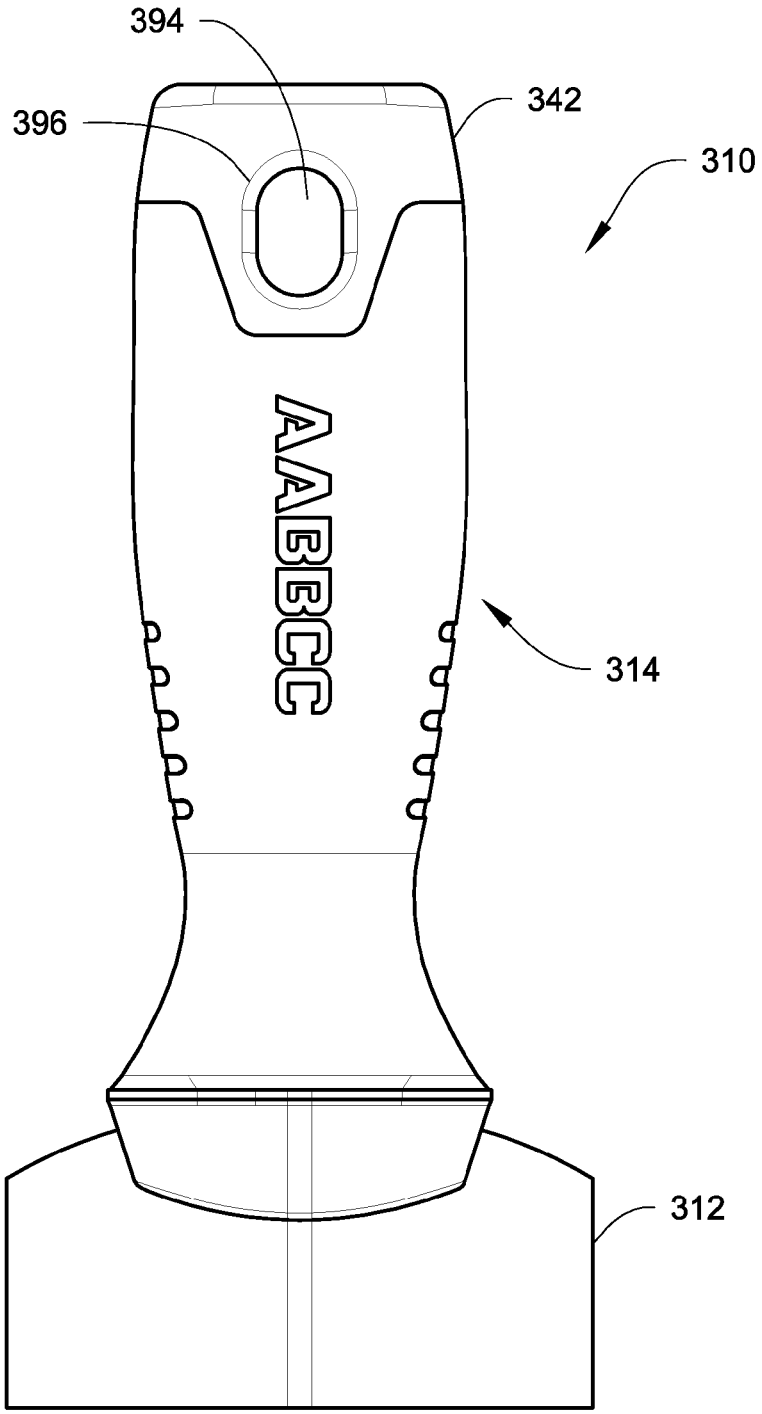
FIG. 2B illustrates a top view of a putty knife without a reinforcement section with a free end being a hammer cap end.

In an alternative embodiment as shown in FIG. 2B, the handle 314 includes a hammer cap 342 sized to receive the first end of the core element for, e.g., nail setting purposes. The hammer cap 342 can be made of various suitable materials such as metal. The hammer cap 342 includes an aperture 394 positioned to align with the aperture defined in the core element, when the first end of the core element is received within the hammer cap 342. The hammer cap 342 is secured in place by a tubular eyelet 396. It is to be understood that other retaining means can be used to retain the hammer cap 342, e.g., adhesive, retaining clip, snap fit connection or screw fasteners.

Figure 3C:
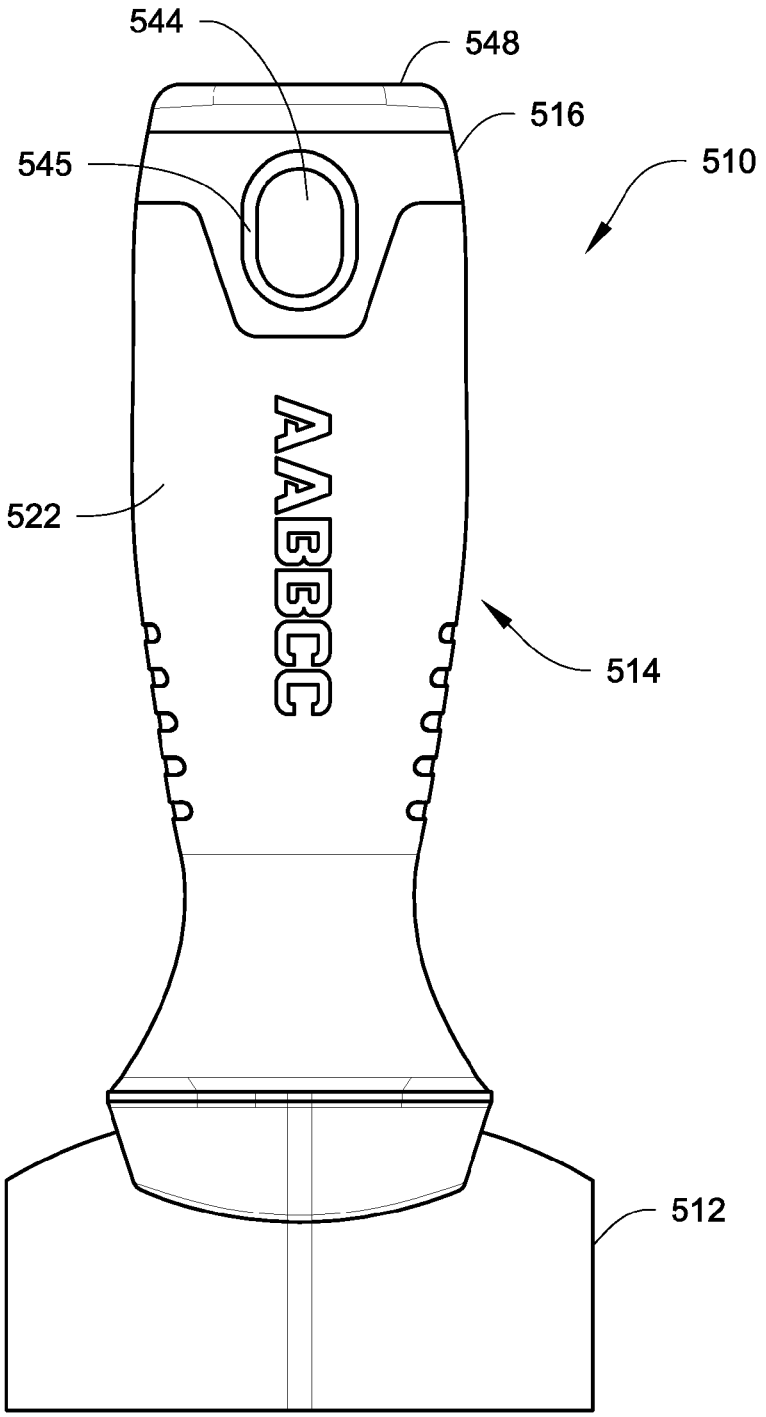
FIG. 3C illustrates a top view of a putty knife without a reinforcement section with a free end being a plastic cap end.

In an alternative embodiment as shown in FIG. 3C, the handle 514 includes a plastic cap 548 to allow the putty knife to do jobs like chiseling in addition to spreading and scraping. In the embodiment as shown in FIG. 3C, the core element, similar to the core element in FIGS. 3A-B (but without the reinforcement section 438), includes an aperture 544 adjacent to the first end 516 of the handle 514. The aperture 544 has a wall raised upwardly above the portion of the core element that is adjacent to the aperture 544. The overlay 522 extends to the aperture 544 and abuts the raised wall, exposing the top and bottom surfaces 545 of the raised wall to an external environment so as to be visible to the viewer. In one embodiment, the color of the end surface 545 is identical to the color of the indicia, the color of the collar or the color the other portion of the core element exposed to the viewer to enhance conveyance of the information represented by the particular color.

Optionally, the handle can further include a self-adhering label attached onto the operative member, e.g., blade. The label can include indicia thereon to illustrate, e.g., the blade flexibility. The location of indicia can vary. The label might be in various forms and sizes, and attached onto the blade by various methods. In an alternative embodiment, the label can also include color coding to convey information represented by the indicia or other information.

To make the putty knife, in one embodiment, the operative member 12 is inserted into a first injection mold by an automated transportation system, e.g., smart vehicles or robot devices. As a result, the core element 20 is molded over the operative member 12.

In addition to the first mold, a second mold is used to mold insert blocks. In one embodiment, flexibility of the operative member, e.g., blade, corresponds to the indicia on the insert block. For example, if the indicia are "FLEX," the blade is moderately flexible; if the indicia are "FULL FLEX," the blade is very flexible; if the indicia are "STIFF," the blade is stiff. In one embodiment, the stiff blade may include a sharp edge (chisel edge) at the end of the blade for easy scraping.

In an alternative embodiment, the other characteristics of the tool can be identified by the indicia. For example, if the indicia are "APPLY," the tool is used to apply compound; if the indicia are "scrape," the tool is used to scrape surfaces. Indicia can also be used to identify the size of the operative member or other characteristics of the tool, e.g., chisel ground, hammer cap, plastic cap, etc. In a further embodiment, the indicia are used to identify the retailer's brand or its partners' brands.

When multiple cavities and insert blocks are used for conveying information, in one embodiment, the multiple insert blocks have identical configurations. Likewise, the multiple cavities for receiving the insert blocks also have identical configurations. As a result, each insert block includes indicia thereon and is interchangeable with other insert blocks so that it can be used to customize the handle with specific marketing information for each size and style blade and for each specific retailer. As a result, the insert blocks and the core element including the cavities allow a quick change of production to make new custom branded products.

After the insert block 30 is inserted in the cavity 28, a third mold is subsequently used to inject the overlay 22 over the core element 20. The raised indicia are then over molded with the overlay 22 whereby the upper surface 84 of the projection 82 and the surface of the over molded overlay 22 are substantially leveled. In this manner, the overlay 22 is formed over an external surface of the core element 20 and formed around the raised indicia on the top surface of the insert block 30 such that the overlay 22 is complimentary with the core element 20.

Depending on the degree of flexibility desired by the manufacturer, as well as aesthetic and tactile considerations, the overlay 22 may be confined to certain area of the core element 20 leaving a portion of the core element 20 exposed, or may overlay and obscure the entire core element 20 with only the upper surface 84 of the projection 82 being exposed. Thus, when finished, the core element 20 may not be visible underneath the overlay 22.

The described embodiments are to be considered in all respects only as illustrative and not restrictive. The scope of the invention is therefore, indicated by the appended claims rather than by the foregoing description. All changes which come within the meaning and range of equivalency of the claims are to be embraced within their scope.

The invention claimed is:

1. A tool handle assembly system for assembling a plurality of tool handles, the tool handle assembly system comprising:

a plurality of core elements each including an elongated body, an outer surface, and first and second ends opposite to each other, at least the second end being adapted to connect with an operative member of a tool apparatus;

at least one cavity extending inwardly from the outer surface of each core element; and a plurality of insert blocks selectively insertable in the cavity, each insert block including:

an exterior surface that divides the insert block into an inner portion insertable in the cavity and an outer portion that extends outwardly beyond the outer surface of the core element when the insert block is received in the cavity; and the outer portion having at least one projection extending from the exterior surface away from the inner portion, the at least one projection having an outline of perimeter in a form of at least a part of desired indicia that convey a first piece of information relating to the respective tool apparatus, wherein the plurality of insert blocks include various indicia that convey various information, wherein each cavity of the core elements selectively receives an insert block to form different tool handles which include different indicia respectively, and wherein one of the insert blocks having indicia that convey the first piece of information is selected to insert into the respective cavity.

2. The tool handle assembly system of claim 1, wherein the first piece of information is one selected from the group consisting of flexibility of a respective operative member, a name of a company, a brand for a respective tool apparatus, a size of a respective operative member, and a function of a respective operative member.

3. The tool handle assembly system of claim 1, wherein an upper surface of the at least one projection of one of the insert blocks has a first color, and at least a portion of an outer surface of one of the tool handles has a second color, one of the first and second colors conveying a second piece of information that confirms the first piece of information.

4. The tool handle assembly system of claim 1, wherein an upper surface of the at least one projection of one of the insert blocks has a color that conveys a second piece of information which confirms the first piece of information conveyed by the indicia is selected to be inserted into the cavity formed in a respective core element.

5. The tool handle assembly system of claim 1, wherein at least a portion of an outer surface of one of the tool handles has a color that conveys a second piece of information, one of the insert blocks having indicia that convey the first piece of information which confirms the second piece of information conveyed by the color is selected to be inserted into the respective cavity.

6. The tool handle assembly system of claim 1, wherein at least a portion of an outer surface of one of the tool handles has a color that conveys a second piece of information, one of the insert blocks having indicia that convey the first piece of information which is different from the second piece of information conveyed by the color is selected to be inserted into the respective cavity.

7. The tool handle assembly system of claim 1, wherein an upper surface of the at least one projection of each of the insert blocks has a first color, and at least a portion of an outer surface of each of the tool handles has a second color, one of the insert blocks having a first color that is identical to a second color of a tool handle is selected to be inserted into the cavity of the respective tool handle.

8. The tool handle assembly system of claim 1, wherein an upper surface of the at least one projection of one of the insert blocks has a first color, and at least a portion of an outer surface of one of the tool handles has a second color, one of the first and second colors conveying a second piece of information that is different from the first piece of information.

9. The tool handle assembly system of claim 1, wherein an upper surface of the at least one projection of one of the insert blocks has a first color, and at least a portion of an outer surface of one of the tool handles has a second color, both of the first and second colors conveying a second piece of information that confirms the first piece of information.

10. The tool handle assembly system of claim 1, wherein an upper surface of the at least one projection of one of the insert blocks has a first color, and at least a portion of an outer surface of one of the tool handles has a second color, both of the first and second colors conveying a second piece of information that is different from the first piece of information.

11. The tool handle assembly system of claim 1, wherein one of the tool handles further comprises a free end, a collar portion that terminates the second end of the respective core element, and an aperture adjacent the first end of the respective core element, a portion of the outer surface of the tool handle that is exposed to the viewer is a surface of at least one selected from the group consisting of the free end, the collar portion and a wall of the aperture.

12. An insertion device to be inserted in a cavity defined in a handle of a tool apparatus, comprising:

an exterior surface that divides the insertion device into an insert portion and a projection portion;

the insert portion having an inner portion and a cover portion, the cover portion including an elongated body that has first end and second end opposite to each other, and two sides extending between the first and second ends; and the projection portion extending from the exterior surface away from the insertion portion, the projection portion having an outline of perimeter in a form of at least a part of desired indicia that convey predetermined information relating to the tool apparatus, wherein when viewed from above the exterior surface of the insertion device, at least a portion of the two sides is tapered when extending from the first end toward the second end.

13. The insertion device of claim 12, wherein the inner portion has a smaller perimeter than the cover portion such that a perimeter recess is formed between the inner portion and the cover portion.

14. The insertion device of claim 12, wherein when viewed from above the exterior surface of the insertion device, a total area defined by the projection portion is smaller than a total area defined by the insertion portion.

15. A tool apparatus, comprising:

an operative member;

a handle connected to the operative member, the handle comprising:

a core element having an elongated body, an outer surface, and first and second ends opposite to each other, at least the second end being connected to the operative member;

at least one cavity extending inwardly from the outer surface of the core element;

an insert block received in the cavity, the insert block having an exterior surface that divides the insert block into an inner portion adapted to be received in the cavity and an outer portion extending outwardly beyond the outer surface of the core element when the insert block is received in the cavity; and at least one projection extending from the exterior surface away from the inner portion, the at least one projection portion having an outline of perimeter in a form of at least a part of desired indicia that convey a first piece of information relating to the tool apparatus; and an overlay disposed on the core element, a height of the at least one projection formed on the exterior surface of the insert block being no less than a thickness of the overlay, thereby exposing the upper surface of the at least one projection to an external environment so as to be visible to a viewer, wherein an upper surface of the at least one projection of the insert block has a first color, and at least a portion of an outer surface of the tool handle has a second color, one of the first and second colors conveying a second piece of information relating to the tool apparatus.

16. The tool apparatus of claim 15, wherein the second piece of information confirms the first piece of information.

17. A method for assembling a plurality of tool handles, each tool handle is adapted to connect to an operative member of a tool apparatus, comprising:

fabricating a plurality of core elements each including an elongated body, an outer surface, and first and second ends opposite to each other, each core element having at least one cavity extending inwardly from the outer surface of the core element;

fabricating a plurality of insert blocks, each insert block including an exterior surface that divides the insert block into an inner portion insertable in a respective cavity and an outer portion extending from the exterior surface away from the inner portion, the outer portion having at least one projection extending from the exterior surface away from the inner portion and having an outline of perimeter in a form of at least a part of desired indicia that convey a first piece of information relating to the respective tool apparatus, wherein various indicia are formed on various insert blocks to convey various predetermined information;

selecting an insert block and disposing the insert block in a respective cavity so that the exterior surface of the insert block is leveled with the outer surface of the respective core element; and obtaining various tool handles including various indicia respectively by assembling the various insert blocks with the core elements.

18. The method for assembling a plurality of tool handles of claim 17, wherein fabricating a plurality of insert blocks includes fabricating a plurality of insert blocks that have identical inner portions, thereby allowing the insert blocks to be interchangeable with each other for engagement with cavities.

19. The method for assembling a plurality of tool handles of claim 17, wherein the first piece of information is one selected from the group consisting of flexibility of a respective operative member, a name of a company, a brand for a respective tool apparatus, a size of a respective operative member, and a function of a respective operative member.

20. The method for assembling a plurality of tool handles of claim 17, wherein selecting an insert block including: selecting one of the insert blocks having indicia that conveys the first piece of information which confirms a second piece of information conveyed by one of 1) a first color of an upper surface of the at least one projection of the respective insert block, and 2) a second color of at least a portion of an outer surface of one of the tool handles.

* * * * *